United States Patent [19]

Juhas

[11] Patent Number: 4,913,395

[45] Date of Patent: Apr. 3, 1990

[54] GIMBALL CHRISTMAS TREE STAND

[76] Inventor: Joseph A. Juhas, North St., Litchfield, Conn. 06759

[21] Appl. No.: 375,455

[22] Filed: Jul. 5, 1989

[51] Int. Cl.[4] ..... A47G 33/12

[52] U.S. Cl. ..... 248/516; 248/527; 47/40.5

[58] Field of Search ..... 248/521, 527, 519, 523, 248/511, 514, 515, 516, 517, 520, 524, 529, 133, 143, 371, 398, 178, 179, 181, 150, 151; 47/40.5, 42

[56] References Cited

U.S. PATENT DOCUMENTS

| | | | |
|---|---|---|---|
| 2,014,896 | 9/1935 | Hollander | 248/525 |
| 2,485,819 | 10/1949 | Doebling | 248/529 |
| 2,518,421 | 8/1950 | Freel | 47/40.5 |
| 2,821,353 | 1/1958 | Hasenohrl | 248/515 |
| 2,933,274 | 4/1960 | Mausolf | 47/40.5 |
| 3,298,642 | 1/1967 | Taylor | 248/524 |
| 3,411,740 | 11/1968 | Schulz | 248/527 |
| 3,591,114 | 7/1971 | Beatty | 248/529 |
| 3,661,349 | 5/1972 | De Vries | 248/527 |
| 4,006,560 | 2/1977 | Schulz | 47/40.5 |
| 4,156,323 | 5/1979 | Scheffler | 248/516 |
| 4,825,586 | 5/1989 | Coppedge | 248/529 |

*Primary Examiner*—Ramon O. Ramirez
*Assistant Examiner*—Robert A. Olson

[57] ABSTRACT

The tree stand is adjustable to accept and position vertically, an evergreen Christmas tree with the root portion removed. The adjustable gimballed structure will position vertically a Christmas tree with the trunk or shaft bent or crooked as much as 15 degress. The stand is composed of a minimum of parts and may be completely assembled or disassembled without the use of hand tools of any kind. This invention relates to an adjustable Christmas tree stand or more broadly to a stand for supporting vertically a fir or various evergreen trees with the sub-surface or root portion removed, commonly known as a Christmas tree.

3 Claims, 3 Drawing Sheets

GIMBALL CHRISTMAS TREE STAND

BACKGROUND OF THE INVENTION

In the erection of a Christmas tree it is most desirable to position the tree in as nearly a vertical attitude as possible. It is often found that the trunk or lower portion of the tree is bent so that the erection in a vertical attitude can only be accomplished by positioning the bent or crooked portion of the trunk oblique to the vertical. It is also desirable that the means to so position the Christmas tree be incorporated into the stand that supports the tree.

An object of this invention is to provide a sturdy yet economical Christmas tree stand which is capable of adjustably supporting the Christmas tree trunk in an attitude diverging from the vertical to compensate for any bend of the trunk.

Another object of the invention is to provide a stand for the purpose stated which can be easily assembled or disassembled without the use of any kind of tooling.

Still another object of this invention is to provide a Christmas tree stand capable of holding a quantity of water to irrigate the tree.

Christmas tree stands incorporating water storage and adjustable positioning means are well known. Examples of prior art are contained in U. S. Pat. Nos. 2,014,896 to Hollander; 2,518,421 to Freel; 3,661,349 to Vries;and references cited therein, other prior art of gripping and positioning techniques without incorporating water storage means are found in No. 2,821,353 to Hassenhoral; and No. 3,591,114 to Beatty.

The examples of prior art cited have met with limited success in providing a Christmas tree stand which would fulfill the objects of the present invention as previously described. For a fuller understanding of the nature and objects of the present invention, reference should be had to the following description taken in connection with the accompanying drawings wherein.

Figure 1:
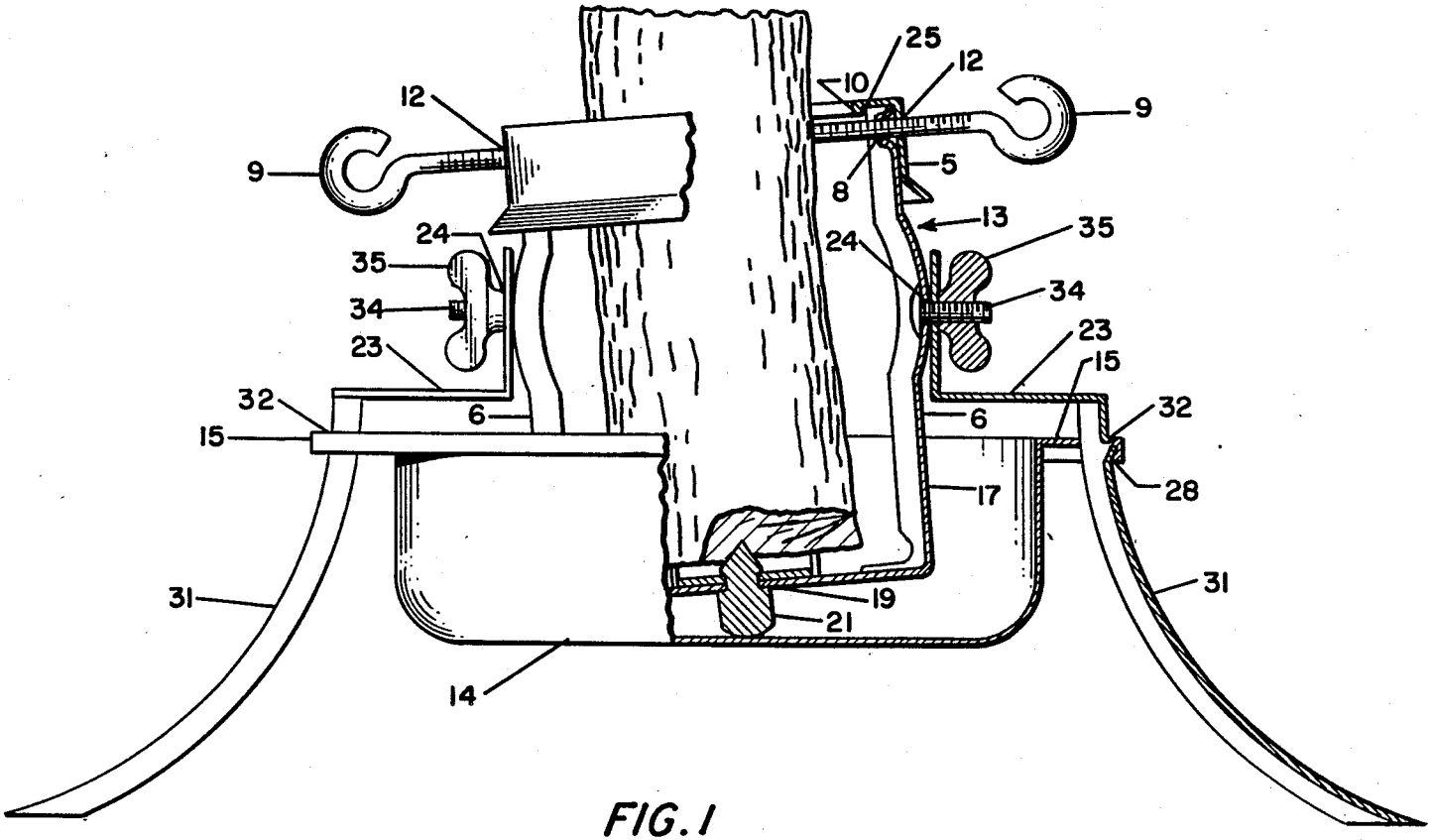
FIG. 1 is a side view of a Christmas tree stand showing partially in cross-section showing a Christmas tree trunk in position therein.
Figure 3:
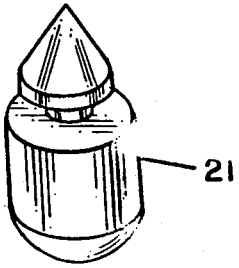
FIG. 3 is a perspective view of an assembly fitting.
Figure 2:
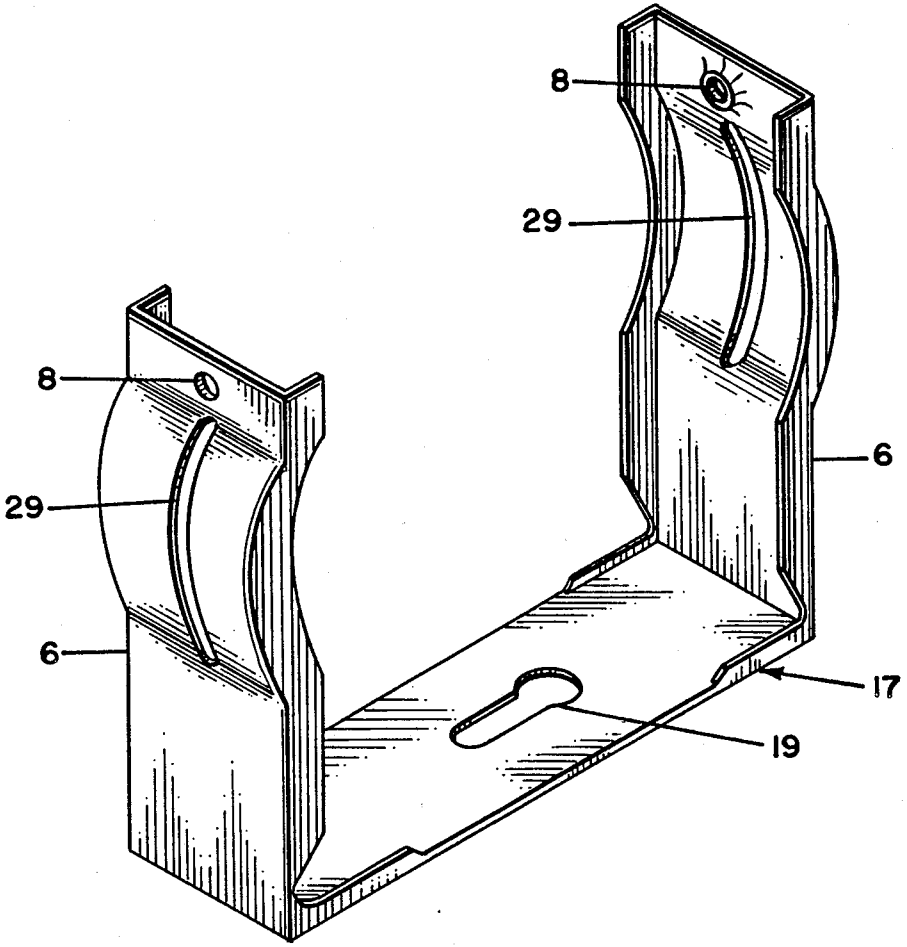
FIG. 2 is a perspective view of a gimball bracket.
Figure 4:
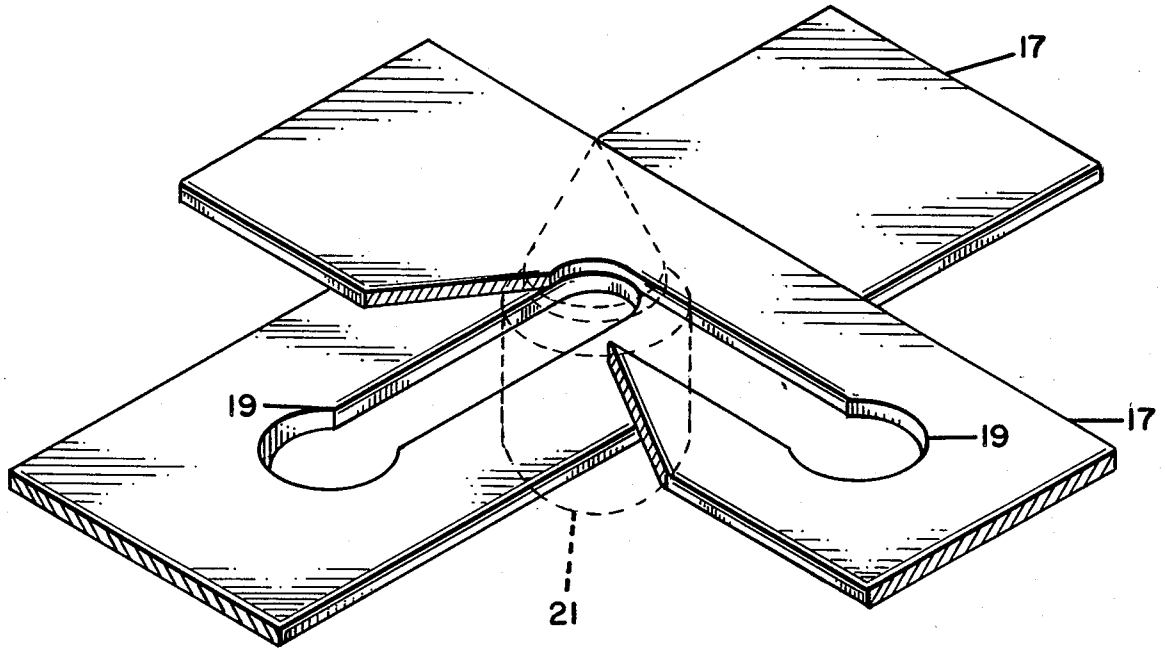
FIG. 4 is a sectioned perspective view of assembly apertures in assembled configuration showing assembly fitting in phanthom.

The Christmas tree stand constructed in accordance with the present invention includes a gimball assembly and water holding pan assembly supported by 4 arcuate legs.

The gimball assembly 13 includes a pair of gimball brackets 17 each of which having an assembly aperture and slot 19 in the base thereof for the insertion and holding of the assembly fitting 21.

Each gimball bracket 17 has two vertical arms, 6 having a channelled cross section. The midsection of each vertical arm being arcuately formed with a radius of curvature approximately equal to the radius of the outer surface of the clamp ring 5. Each arcuately formed midsection having a centrally located slot 29 extending the entire length of the arcuate section.

The extreme upper end of each vertical arm 6 having a centrally located threaded aperture 8 for accepting a threaded eye-bolt 9.

The upper end of the gimball assembly terminates in an upper clamp ring 5. The upper clamp ring 5 is formed with a cylindrical outer surface the lower end is flared to a slightly larger diameter. The upper end of the cylindrical section having a centrally directed radial flange which in turn has an axially directed flange or lip 10 forming a trough or channel with the cylindrical surface.The upper clamp ring 5 has four equally spaced clearance apertures 12 to accept the threaded eye-bolts 9.

The water holding pan assembly consists of a bowl shaped water container 14 the upper edge of which is formed into a horizontal flange 15 with a downward directed vertical lip or flange to structurally stiffen the horizontal flange 15. The upper horizontal flange 15 having four equally circumfrentially spaced rectangular apertures 32. The water holding pan assembly is supported by four arcuate shaped legs 31 having channel cross section, each leg terminating in a foot at the lower end and a right angle securing flange 23 at the upper end. Each right angle securing flange 23 has in its vertical surface, an aperture 24 through which is passed a threaded bolt 34 to attach the right angle securing flange 23 to the arcuate portion of the gimball bracket 17 by means of a wing nut 35.

Each support leg 31 passes through a rectangular aperture 32 in the upper horizontal flange 15 of the water container 14. Each support leg 31 has a lanced tab 28 near its upper end to support the water container 14 and to limit the distance the suppot leg 31 can progress through the rectangular aperture 32 in the upper flange 15 of the water container 14.

The assembly of the Christmas tree stand is accomplished as follows, the two gimball brackets 17 are positioned with the bases in contact and oriented at right angles to each other and with assembly apertures 19 in allignment. The assembly fitting 21 is inserted into the assembly aperture 19 and moved to the extreme end of the slot in each gimball bracket. The upper ends of the gimball bracket 17 are inserted into the trough or channel 25 of the upper clamp ring 5 with the apertures 8 in the upper ends of the gimball bracket 17 in alignment with the apertures 12 in the upper clamp ring 5. An eye bolt 9 is inserted into each clearance aperture 12 in the upper clamp ring 5 and threaded into the threaded apertures 8 in the upper end of the gimball bracket 17.

The four arcuate legs 31 are inserted to the underside of the four rectangular apertures 32 in the upper horizontal flange 15 of the water holding pan 14 with the lanced tab 28 in contact with the underside of the upper horizontal flange.

The gimball assembly is then lowered into the water holding pan 14 with the spherical end of the assembly fitting resting on the bottom of the water holding pan with the apertures 24 in the right angle securing flange 23 in alignment with centrally located slots 29 in the arcuate section of the gimball bracket 17. The gimball assembly is loosely assembled to the securing flanges 23 with bolts 34 and wing nuts 35.

The trunk of the Christmas tree is then inserted into the upper clamp ring 5 and in contact with the pointed end of the assembly fitting 23. A sharp blow on the bottom of the water holding pan 14 causes the pointed end of assembly fitting 24 to enter the bottom surface of the tree trunk. The four eye-bolts 9 are advanced to position the tree trunk concentricàlly with the upper clamp ring 5, the 4 wing nuts are tightened and the Christmas tree and stand are placed in an upright position. While holding the Christmas tree upright, the 4 wing nuts are loosened, and the Christmas tree is adjusted to the desired vertical attitude and the four wing nuts 35 are tightened to secure the tree in the selected vertical attitude.

Changes in details may be made to the form of the invention herein shown and described without departing from the spirit of the invention or the scope of the following claims:

I claim:

1. A stand for supporting a christmas tree or similar elongate shaft in a vertical or selectively inclined attitude said stand comprising in combination a gimball assembly having an upper clamp ring receptive of a Christmas tree trunk or similar elongate shaft, said upper clamp ring being attached to the upper ends of two gimball brackets by means of threaded eye-bolts, each of said gimball brackets having a base and two vertical arms, each of said vertical arms having a channel cross section and having a linear upper and lower section separated by an convex arcuate midsection, the radius of curvature of said arcuate midsection being at least equal to the radius of the said upper clamp ring, said arcuate midsection of each of said gimball bracket arms having an elongate slot located at the center of said channel cross section and extending the full length of said arcuate midsection, the bases of said gimball brackets being held in contact and in cruciform orientation by an assembly fitting passing through an assembly aperture slot means in the base of each of said gimball brackets; a circular formed water storage pan having a radially extending upper flange, said flange having four equally circumferentially spaced rectangular apertures, said water storage pan being supported by four arcuate leg members having a channel cross section each of said leg members terminating in a support foot at the lower end and a right angled securing flange at the upper end, each of said leg members fitted into one of said rectangular apertures in said radially extending flange of said water storage pan, one each of said right angled securing flanges being attached by bolt and wing nut means to one each of the said arcuate midsections of said gimball bracket arms.

2. The combination as defined in claim 1 wherein said upper clamp ring is attached to the said gimballed bracket by one each of four threaded eye-bolts passing through one each of four equally circumferentially spaced clearance apertures in the said upper clamp ring and threaded through one each of threaded holes in the upper ends of the said gimball brackets.

3. The combination as defined in claim 1 wherein said gimball assembly is supported by said assembly fitting in contact with the bottom inside surface of the said water storage pan and held in selected attitude by one each of said bolts passing through one each of said elongated slots in the said arcuate sections of said gimball brackets and through apertures in one each of said right angled securing flanges and threadedly secured with one each of said wing nuts.

* * * * *